United States Patent [19]

Tuckey

[11] 4,401,416

[45] * Aug. 30, 1983

[54] SELF-CONTAINED ROTARY FUEL PUMP

[75] Inventor: Charles H. Tuckey, Cass City, Mich.

[73] Assignee: Walbro Corporation, Cass City, Mich.

[ * ] Notice: The portion of the term of this patent subsequent to Oct. 5, 1999 has been disclaimed.

[21] Appl. No.: 228,346

[22] Filed: Jan. 26, 1981

Related U.S. Application Data

[63] Continuation-in-part of Ser. No. 123,102, Feb. 19, 1980, abandoned.

[51] Int. Cl.[3] ..... F04B 49/08

[52] U.S. Cl. ..... 417/283; 417/310

[58] Field of Search ..... 417/310, 283; 418/135

[56] References Cited

U.S. PATENT DOCUMENTS 3,679,329 7/1972 Drutchas et al. ..... 417/310

4,352,641 10/1982 Tuckey ..... 417/283

*Primary Examiner*—Richard E. Gluck

*Assistant Examiner*—Peter M. Cuomo

*Attorney, Agent, or Firm*—Barnes, Kisselle, Raisch, Choate, Whittemore & Hulbert

[57] ABSTRACT

An electric fuel pump which is self-contained in a unitary housing with a fuel inlet at one end leading to a rotary eccentric pump, the pumped fuel passing out an outlet at the other end of the housing. A relief valve in the form of a shaped plate at the pump end by-passes fuel when there is reduced demand at the outlet. The outlet end of the pump is formed as a brush holder for the electric drive motor and a magnet retainer for the field assembly. A substantially constant pressure at the outlet with varying flow demands is the function of the relief valve.

14 Claims, 18 Drawing Figures

4
84
86
83
14
42
-82-
-80-
62
64
88
30
40
50
51
60
3
66
190
180
176
26
24
170
174
172
70
76
-66-
146
2
22
42
150
130
160
140
122
60
134
124
120
112
110
126
20

SELF-CONTAINED ROTARY FUEL PUMP

This application is a continuation-in-part of my application, Ser. No. 123,102, filed Feb. 19, 1980, now abandoned, entitled "Self-Contained Rotary Fuel Pump".

FIELD OF INVENTION

The invention is directed to fuel pumps for internal combustion engines and particularly to pumps useful on automotive vehicles to furnish fuel from the gasoline tank to the engine in response to demands of the engine.

REFERENCE TO RELATED APPLICATION

Reference is made to my copending application, filed simultaneously with this application, Ser. No. 123,103, filed Feb. 19, 1980, entitled "Self-Contained Rotary Fuel Pump", now U.S. Pat. No. 4,352,641, issued Oct. 5, 1982.

BACKGROUND OF THE INVENTION

Automotive vehicles have used gravity feed for fuel in the early stages of the industry and the next phase beyond this was a diaphragm pump in which the diaphragm was mechanically pulsed by a lever actuated by a cam actuated by the engine itself. Also, electric pumps have been used with the pumping action provided by a solenoid armature reciprocating in a solenoid winding in response to electrical contacts in a circuit responsive to the motion of the armature.

In every case there is a problem of matching the fuel supply to the demand of the engine under all conditions of operation, whether it be idling, full open throttle at high speed, or open throttle under load such as climbing a hill or moving through sand or snow where the load causes a reduced speed even with open throttle.

It is also important to have a fuel pump which will have a reliable output under all conditions of ambient temperature in winter and summer.

It is an object of the present invention to provide a constant speed rotary electric pump which can yet respond to fuel demand by the operation of a unique relief or by-pass valve at the rotary pump inlet. A further object is a rotary pump design which has a steady, even output flow with minimal surging in the output so the engine fuel mixing device can perform its function unaffected by a surging fuel supply.

Another object is a pump design which is compact and of a size to be easily mounted in a safe area in an automotive vehicle. It can be mounted in or out of the fuel tank.

Other objects include providing a pump relief system which can provide a substantially constant pump outlet pressure even though the outlet flow may vary from the maximum desired flow to a minimum flow.

The pump incorporates a simple pressure regulator valve in conjunction with pulse absorption device to provide a smooth flow of fuel. The pressure relief valve is designed for an initial lift-off in response to pump pressure and automatically expose additional area to the pressure to steady the by-pass and avoid an erratic or jerky "hunting" for the desired pressure. Attention is directed to U.S. patents to Catterson, U.S. Pat. No. 3,415,195, dated Dec. 10, 1968, and O'Connor, U.S. Pat. No. 3,470,824, dated Oct. 10, 1969, where a magnetic relief valve plate is utilized in conjunction with a rotary fuel pump.

A further object is the provision of a retainer shell which holds the respective parts together under resilient compression in a sealed relationship.

A further object of the invention is the provision of a pump outlet plate having a spherical bearing seat for a motor shaft which permits self-alignment, and a relief valve plate formed on the pump inlet plate cooperating with a pressure plate to permit by-pass of outlet pressure to the inlet side of the pump under controlled conditions.

Other objects and features of the invention will be found in the following description and claims in which the principles of the invention are set forth, together with a detailed description and parts which make up the operating assembly, all in connection with the best modes presently contemplated for the practice of the invention.

BRIEF DESCRIPTION OF THE DRAWINGS

Drawings accompany the disclosure and the various views thereof may be briefly described as.

DESCRIPTION OF THE INVENTION AND THE MANNER AND PROCESS OF MAKING AND USING THE INVENTION

Figures 1, 14:
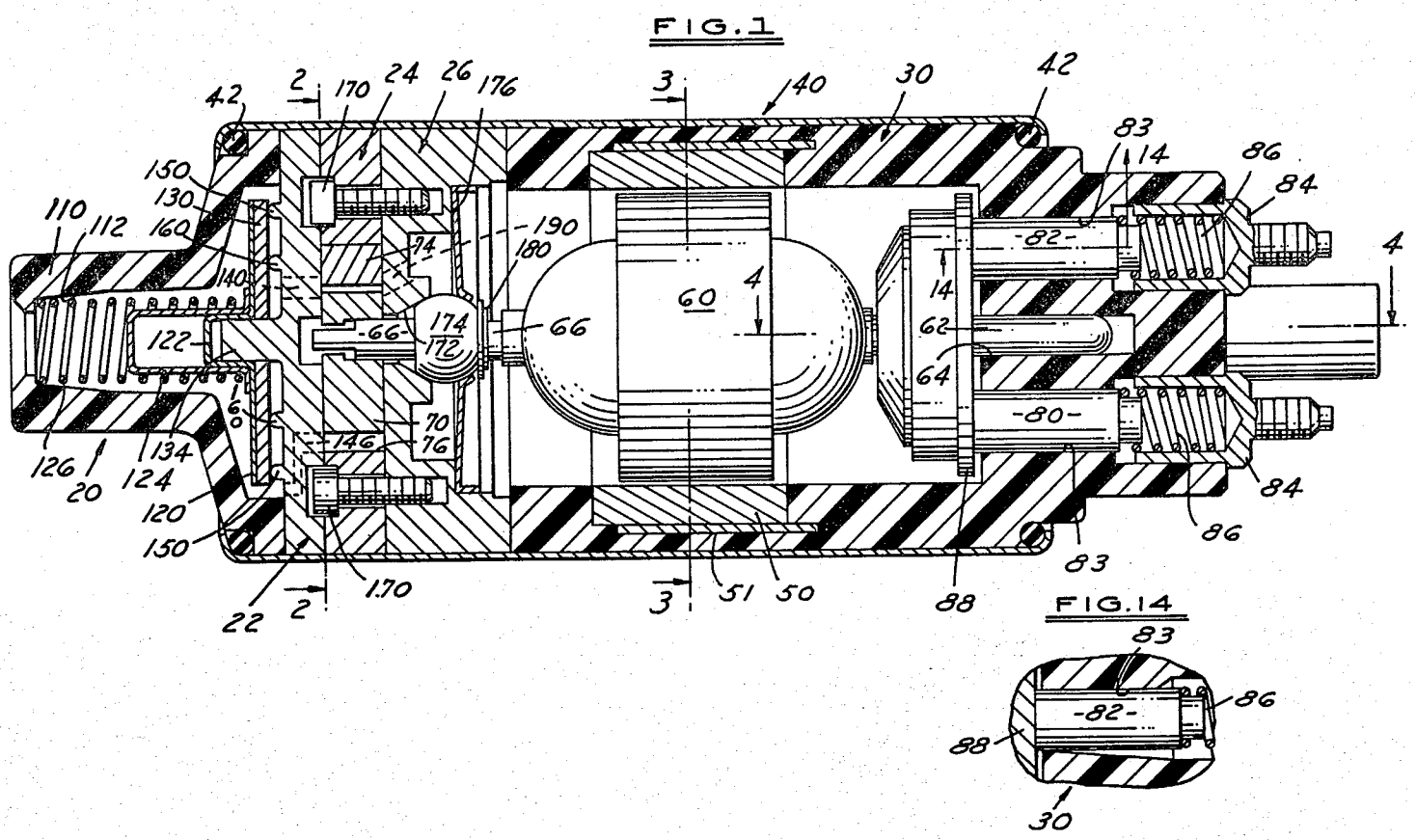
FIG. 1, a longitudinal section showing the pump in assembly.
FIG. 14, a sectional view on line 14—14 of FIG. 1.

In FIG. 1, an assembly view of a fuel pump illustrates all of the vital parts. From the inlet end at the left to the outlet end at the right, the basic parts include an inlet cover 20, a pump end plate 22, a pump housing in the form of a cam ring 24, a pump end plate and bearing retainer 26, and an armature housing and outlet end housing 30. All of these parts are held securely together axially by a cylindrical metal shell 40 which at one end is formed over the periphery of the inlet cover 20 and, at the other end, is formed over a compressible O-ring 42 which lies against a shoulder on the outlet end housing 30.

Figure 4:
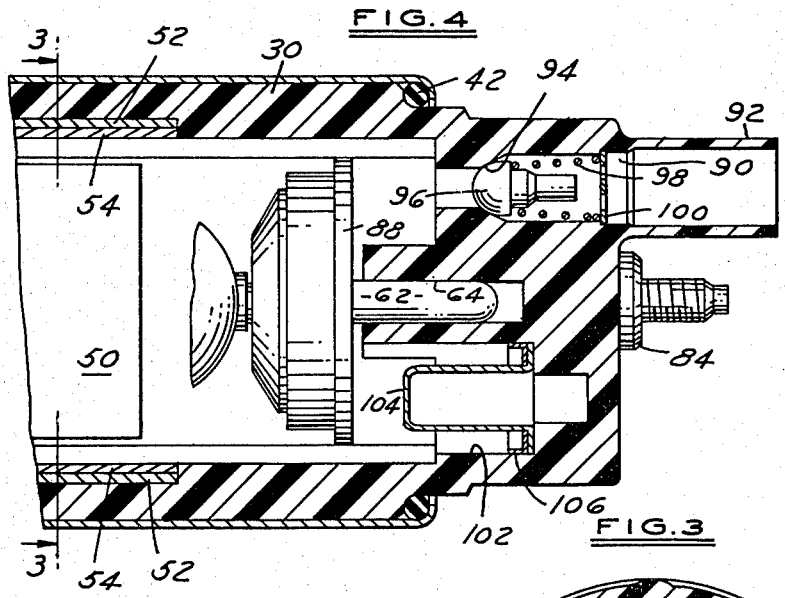
FIG. 4, a sectional view of the right-hand outlet end of the pump at 90° to the showing of FIG. 1.
Figure 3:
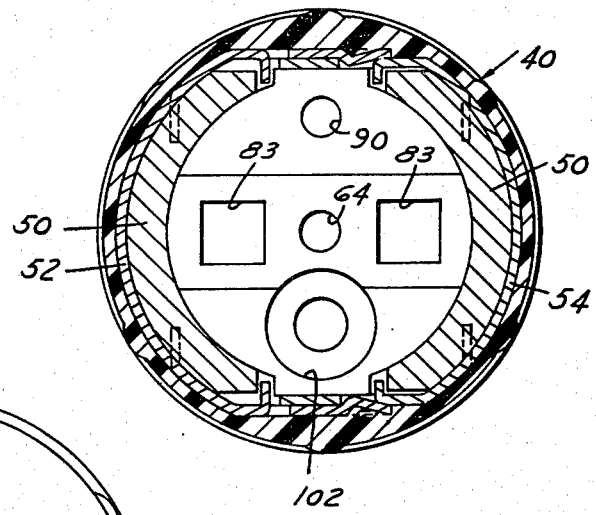
FIG. 3, a sectional view on line 3—3 of FIG. 1 and FIG. 4 absent the motor winding.
Figure 2:
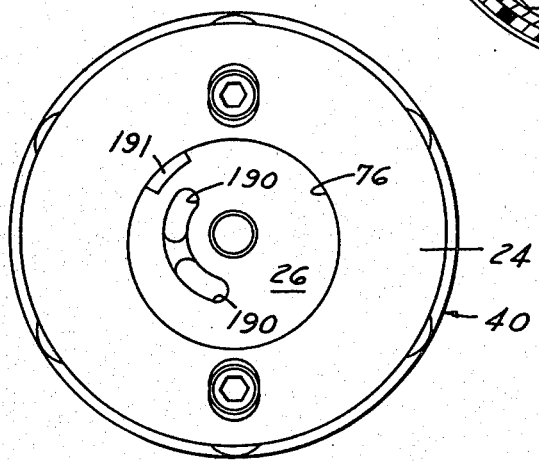
FIG. 2, a section on line 2—2 of FIG. 1 omitting the pump rotor and vanes.
Figure 5:
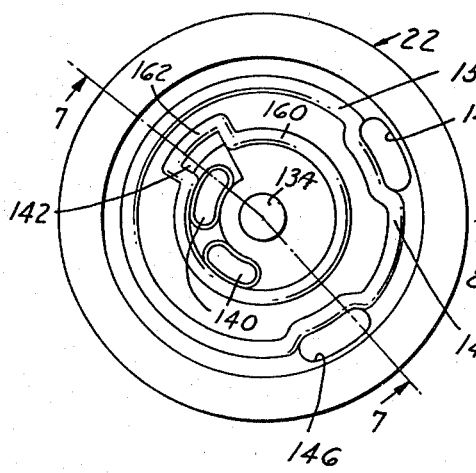
FIGS. 5 and 6, elevation views from the respective sides of a pump housing cover plate.
Figure 6:
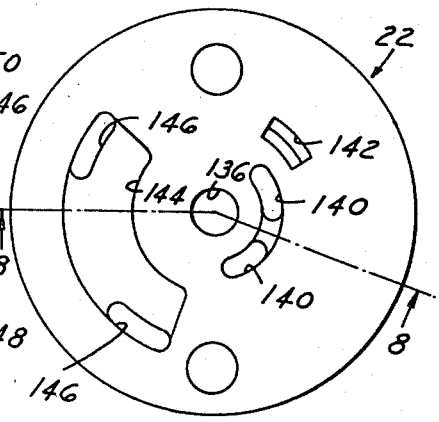
Figure 7:
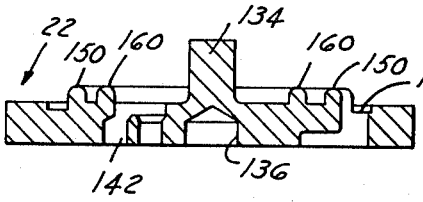
FIGS. 7 and 8, sectional views taken, respectively, on lines 7—7 and 8—8 of FIGS. 5 and 6.
Figure 8:
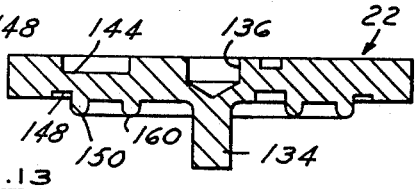

As shown in FIGS. 1, 4 and sectional views in FIGS. 2 and 3, a magnet flux assembly utilizing permanent magnets 50 and a flux ring 51 encompassing the magnets is mounted within the housing 30 retained by retainer rings 52 and 54 which interengage at the ends to hold the semi-circular flux rings in place. The outlet end housing 30 and the magnet flux assembly with magnets 50 and flux ring 51 are preferably molded in a one-piece assembly to serve as a module in the assembly within the metal shell 40. The rings 52, 54 can be used to hold the parts in place during the molding operation or used independently if the flux assembly is intended to be demountable.

Figure 10:
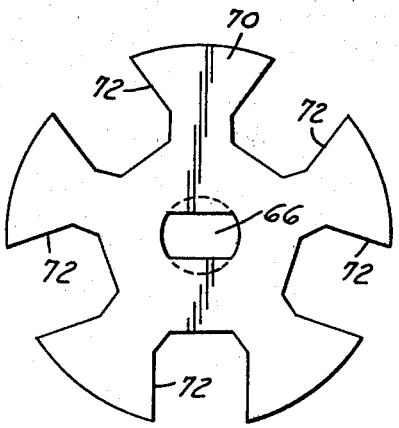
FIG. 10, an elevation of a vane-type pump rotor.

An armature and retaining ring assembly 60 within housing 30 has a shaft 62 which is received in a central opening 64 at one end, and the other end of shaft 60 at 66 projects through pump plate and bearing assembly 26 and into the pump rotor 70. Opening 64 is shaped and dimensioned to allow slight cocking of shaft end 62 to adjust for alignment of the armature and pump housing. This shaft has a driving relationship with a pump rotor 70 shown enlarged in FIG. 10. Circumferentially spaced slots 72 opening to the periphery of the rotor carry rollers 74, one of which is shown in FIG. 1, the rotor operating in an eccentric recess 76 in cam ring 24 in a manner well known in the vane pump art.

Brushes 80 and 82 are retained in axial holes 83 (FIG. 3) in housing 30 by electrical connector caps 84 which holds springs 86 against the brushes and urge them against the commutator plate 88 on the motor assembly. A sectional view in FIG. 14 taken on line 14—14 of FIG. 1 illustrates that the holes 83 are enlarged on one side to allow the brushes to tilt slightly in the drag direction imposed by the rotation of the commutator plate 88. This slight tilt avoids the chatter that may develop when the brush is square against the plate. For example, in FIGS. 1 and 4, if the commutator plate is rotating in a clockwise direction as viewed from the right end, the brushes 80, 82 will cock so the contact end is moved in the direction of the plate rotation, the trailing end moving in the opposite direction. The contact end of the brushes will accordingly wear at a slight angle as the motor is used. The brushes are preferably octagonal in cross-section and mounted in square holes 83. As shown in FIGS. 3 and 4, the outlet end of the pump has an outlet passage 90 leading to tubular nipple 92. A valve seat 94 cooperates with a dome-shaped valve 96 urged against the seat by a spring 98 retained by a perforate retainer disc 100.

A cylindrical blind hole 102 houses a resilient, flexible, hat-shaped elastic member 104 formed of rubber or a similar hydrocarbon resistant material, FIG. 3, the rim of which is held and sealed against a shoulder by a retainer ring 106. This member 104 serves as a dampener or pulse absorber to smooth out the pump outflow. This member 104 is installed in a manner to trap a quantity of air at above atmospheric pressure. These pumps may operate to produce pressures of 10 to 30 pounds per square inch. Thus, if the member 104 is to serve as a pulse dampener, the entrapped air must be in the range of the pump operating pressures. This increase in pressure can be obtained by the fit between ring 106 and the rim of the member 104. Together these form an air tight fit with the wall of recess 102. Thus, when the ring and the rim are forced into the recess, a quantity of air is entrapped in the hat-shaped member 104 and compressed to above atmospheric pressures. The crown of the hat is of lesser diameter than recess 102.

Figure 11:
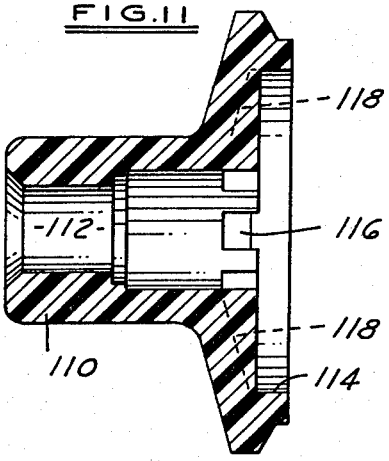
FIG. 11, a sectional view of a fuel inlet cover.
Figure 12:
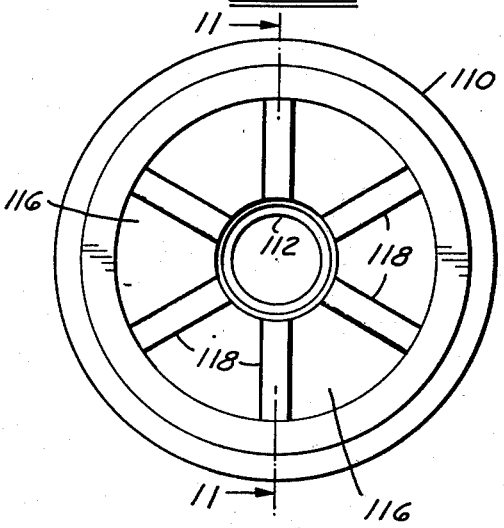
FIG. 12, an elevation of the inner side of the inlet cover.

Turning now to the pumping section of the pump, the inlet cap 20 is shown in FIGS. 11 and 12 with a nipple projection 110 surrounding an inlet passage 112 which widens into a flat circular recess 114 with a ribbed back wall 116, the ribs 118 providing strength to the cap 20. A thin circular disc valve 120 has a cup-like protuberance 122 and this protuberance mounts a flexible dampener cap 124 and also pilots a spring 126. The protuberance 122 serves as a pilot mount for the dampener cap 124 and as a locator for one end of the coil spring 126 which seals a short flange of cap 124 to the flange 120. A thick rubber pad 130 serves as a seal between valve disc 120 and annular ridges to be described.

The cup 122 is supported on a central protuberance 134 of a pump end plate 22 which closes one end of the pumping recess 76 in cam ring 24. The pump end plate 22 is detailed in FIGS. 5 to 8. A short central recess 136 is axially aligned with protuberance 134 on the opposite side of the plate to provide clearance for the rotating pump shaft 66. The plate 22 is preferably made of aluminum with a hardcoat anodization. Two connected kidney-shaped ports 140 adjacent the center of the plate perforate the plate. Adjacent and radially outside one end of these ports is a short arcuate port 142. A larger arcuate shallow recess 144 in the inner face of plate 22 has at each end at the outer radius a kidney-shaped port 146 which perforate the plate to form inlet ports for the pump.

On the outer face of plate 22, the ports 146 open to an annular shallow groove 148 on the inner periphery of which is a raised essentially annular ridge 150. This ridge is rounded in cross-section on its edge and is annular except where it jogs in to accommodate the ports 146. A second inner annular ridge 160 of the same height as the first ridge encompasses the outer periphery of the ports 140 but jogs out at 162 to include the small arcuate port 142. As is evident in FIG. 1, the circular resilient pad 130 backed by the valve disc 120 is pressed against the outer face of the plate 22 and particularly against the rounded surfaces of the ridges 150 and 160.

Proceeding inwardly in the pump assembly, the rotor housing or cam ring 24, which has the eccentric recess 76, and houses the rotor 70 and vanes 74, is mounted by headed bolts or cap screws 170 on the annular pump end plate 26. The holes in housing 24 through which the bolts pass, are slotted to permit shifting of the cam ring for adjustment purposes in assembly. In practice, on a pump with an outer diameter of about $1\frac{3}{4}''$ and a rotor with about $\frac{3}{4}''$ diameter, a clearance of 0.002" is desired. Thus, using a gauge ring 0.002" larger than the intended rotor, the cam ring can be set exactly in the proper position and locked by the cap screws 170.

Figure 9:
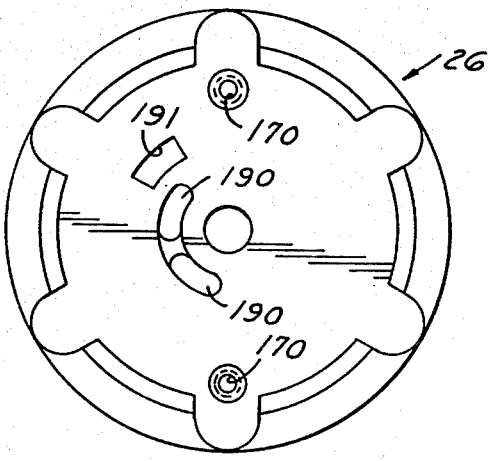
FIG. 9, an elevation of a rear plate of the pump housing serving also as a bearing retainer.

The end plate 26 is shown in elevation in FIG. 9. It has a central opening to accommodate shaft 66, the opening enlarging into a conical seat 172 for a spherical bearing ball 174 retained resiliently by a pressed-in, flanged disc 176. A thrust washer 180 is provided at the bearing. The disc 176 is of open construction to permit the flow of liquid through it.

The plate 26, as shown in FIG. 9, has connected kidney-shaped ports 190 and also an arcuate outlet port 191 which perforate the plate to allow liquid output from the pump to pass through and around the armature assembly 60 to the outlet port 90 of the pump.

IN THE OPERATION

Inlet fluid from a tank supply enters nipple 110 (FIG. 1) to passage 112 and flows radially outward through radial grooves 118 to the periphery of plates 120 and 130. Plate 22 has inlet passages 144, 146 open to the inlet cavity in cap 110 (FIGS. 1 and 6) to carry inlet fluid to the ports 146 at the periphery of the vane pump in cam ring recess 76. As the roller vanes 74 move in the eccentric recess, the inlet fluid is moved into narrowing portions of the recess between the vanes until it is squeezed out of the kidney ports 190 and the arcuate port 191 in pump end plate 26. The fluid under pressure flows pass the armature assembly to the valve controlled outlet 90, 92 (FIG. 4). The valve 96 serves to hold fuel in the pump in periods when the pump is not rotating and also to serve as a safety valve to retain in the event a vehicle is overturned.

The outlet pressure is also reflected back to the valve plates 120, 130 through ports 140, 142 in plate 22 where it fills the moat within the closed annular ridges 160. When this pressure reaches a point that the pressure of spring 126 bearing on plate 130 is overcome, the outlet fluid will spill over ridge 160 into the moat between ridges 150 and 160. If the pressure here again overcomes the spring, the fuel will by-pass to the inlet chamber of the pump and into the inlet ports 146, and continue to by-pass until the desired outlet pressure is reached.

Figure 13:
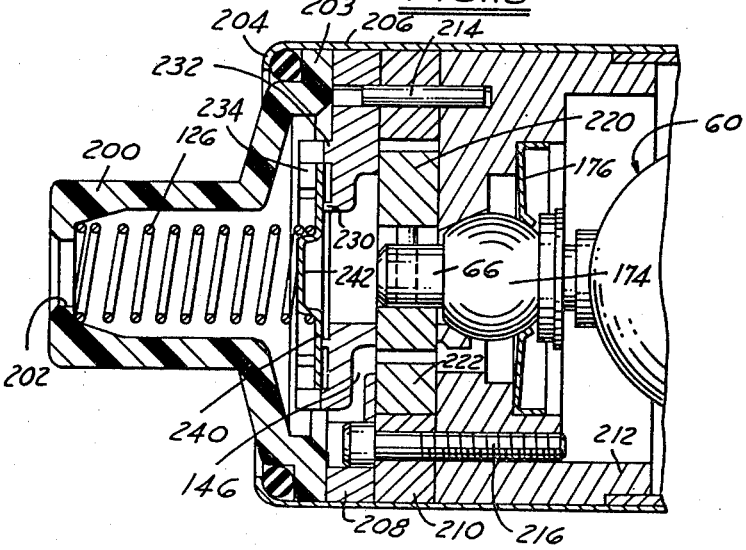
FIG. 13, a sectional view of the inlet end of a pump showing a modified relief valve construction.

In FIG. 13, a modified relief valve structure is shown. An inlet cap 200 with an inlet passage 202 has a flange 203 secured by a turned in section 204 of the outer shell 206. A pump inlet plate 208, with an inlet port 146, and a pump cam ring 210, are located and secured to pump outlet plate 212 by a pin 214 and bolt or cap screw 216. A pump rotor 220 operates within the cam ring and has vanes 222. A motor shaft 66 has a drive connection with the rotor 220 and a ball mount 174 with a retainer plate 176 are provided as previously described in connection with FIG. 1.

The pump inlet plate 208 has on its outer face an annular ridge 230 surrounding a central opening and outside this ridge is a second annular wall which has a solid base 232 with an axial dimension similar to the ridge 230 and a further axial wall 234 with radial slots opening to the inlet chamber within the end cap 200, thus forming a broken wall or ridge outside ridge 232. The periphery of the plate 240, in closed position, lies in close proximity to the annular ridge 232 but with a working clearance which permits the plate to move axially without binding. Thus, in closed position, there is an annular pressure chamber between ridges 230 and 232. Springs 126 backs circular plate 240 which has a flat annular surface resting on the ridge 230 and extending outwardly to lie concentrically within the wall 234. Spring 126 seats on a central cup-like extension 242.

Thus, pressure developing in the pump will be exerted against the plate 240 and tend to lift it against the force of spring 126 so fluid may pass over the ridge 230 and out of the slots in the wall 234. It may then enter the pump inlet again and be by-passed until outlet pressure in the pump reduces below the spring setting acting on plate 240.

Figure 15:
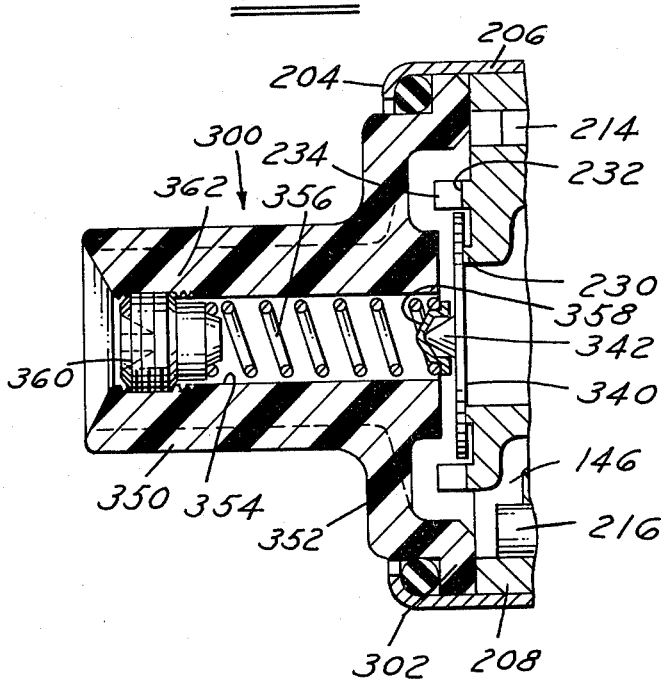
FIG. 15, a sectional view of a modified relief valve structure on line 15—15 of FIG. 16.
Figure 18:
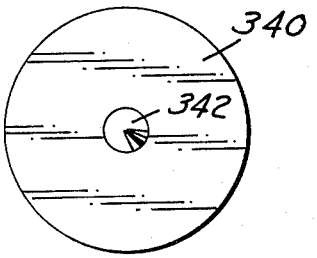
FIG. 18, an elevation of the modified valve plate of FIG. 15.
Figure 16:
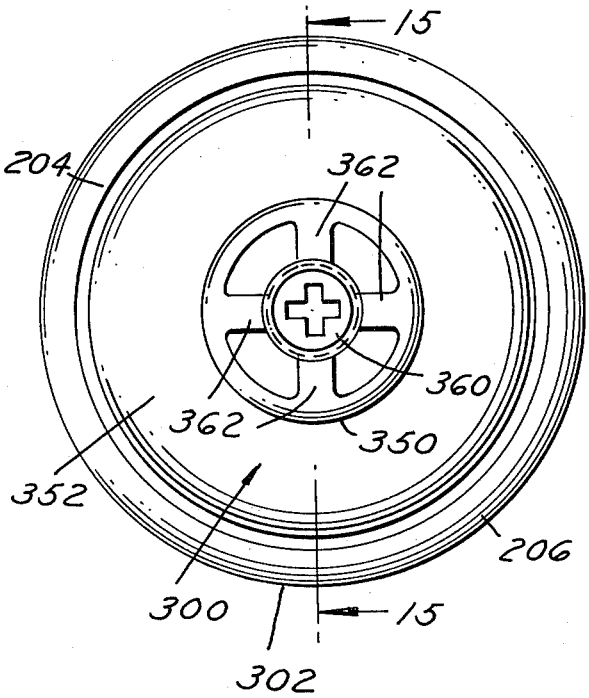
FIG. 16, an end view from the left-hand of the assembly of FIG. 15.
Figure 17:
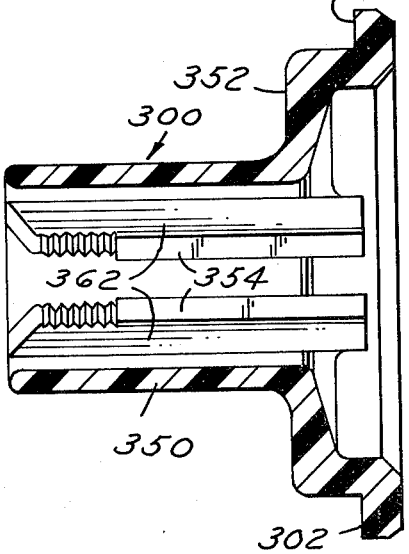
FIG. 17, a sectional view of the inlet cover of the modified structure of FIG. 15.

A modified relief valve and inlet cover is illustrated in FIGS. 15 to 18. The relief valve cover or inlet cap 300 has a retaining flange 302 captured by the inturned end 204 of the outer shell 206 as shown in FIGS. 13 and 15. The large diameter portion of the inlet cap is pressed against the pump inlet plate 208 as described in connection with FIG. 13. This plate 208 has a short annular ridge 230 around the opening in the inlet plate and a second annular wall or parapet with a solid base 232 with an axial dimension similar to the ridge 230 and a further axial wall 234 with radial slots as shown in FIG. 13. These slots have been omitted from FIG. 15 for clarity of the showing.

Overlying the center of pump inlet plate 208 is a circular valve plate 340 (FIG. 15) having a central conical projection 342 facing the center of the inlet cap 300.

The inlet cap 300 has a cylindrical fuel nipple portion 350 projecting outwardly from a wider flange and valve housing portion 352. The nipple portion has a central bore 354 to receive a compression coil spring 356 bearing at one end against rim flange on a small cup 358 having a conical bottom with a wider angle than that of core 342 so that the apex of the core bears in point contact with the inner apex of the cup 358. The other end of the spring seats on a truncated conical tip of a threaded screw 360 (with a wrench recess) threaded into the outer end of bore 354. The material of the nipple portion 350 is slotted to provide inwardly extending radial ribs 362 (FIG. 16) which locate spring 356, the open channels between the ribs forming axial inlet flow passages for fuel.

In the operation of the device, first of all, the spring adjustment screw 360 allows an easy calibration of the valve plate pressure by rotation of the screw. The needle point contact between core 342 and cup 358 allows the spring to turn without any accidental wind-up. This adjustment can be made at the factory to insure proper spring pressure on plate 340 to provide the desired relief pressure of valve 340.

The plate 340 preferably has 0.001" to 0.003" radial clearance between the perimeter of the plate and the ridge 232 with the slotted upstanding wall. This dimension will be standardized for a particular pump. An advantage of this design over that shown in FIGS. 1 and 13 is that the tolerance problems in maintaining two annular contacts may creates some non-uniformity in actual production. With the use of the single annular ridge 230 and the spaced and slotted ridge 232, 234, the tolerance problem is eliminated and it has been found that, despite the radial clearance at the periphery of the plate 340, a resistance develops at this outer parapet which serves as a secondary barrier to the relief pressure which will gradually reduce as the plate 340 lifts off from the primary ridge 230. The annular parapet serves also to center the plate 340 in conjunction with the spring and center core 342. The flow capacity of the openings in the parapet is controlled and may be calibrated for varying capacity pumps to achieve a balance.

Thus, the embodiment of FIGS. 15 to 18 can be characterized as a single ridge device with a slotted regular wall or parapet outside the valve plate. With the conical needlepoint pressure device, there is a closing force only on the plate and it is free to rock and thus more responsive since there is no binding force either at the perimeter or at the center. In addition, the bench adjustment, as pointed out, eliminates any spring wind-up which would affect the ultimate operation.

To define the operation in more detail, pressure builds up on the valve plate 340 within the central ridge 230 and, upon reaching a predetermined pressure, fluid flows out into the annular space outside the ridge 230 and inside the annular parapet 232–234. Some fuel will escape in the radial clearance of preferably 0.001 to 0.003" at the perimeter of the plate 340 but pressure under the plate will lift the plate and allows flow through the radial slots to function in relief without perceptible increase in pressure within the central ridge pocket.

If there were no slotted wall 234, the valve plate would lift and decrease the pump outlet pressure. So the calibrated slots permit pump pressure to remain relatively constant which is a highly desirable condition. This operation works in a relatively wide flow range without increase in outlet pressure. For example, the outlet pressure fluctuation can be held to 1 1½ pounds as distinguished from 5 to 10 pounds with standard by-pass relief valves. The present structure differs from conventional units in that with a regular spring-biased ball valve relief, when the flow out of a pump is restricted, the pressure will climb because it takes added pressure to by-pass flow of more fuel. As indicated, the present structure does not significantly increase the outlet pressure when the pump outlet is restricted or the pump by-pass flow increased.

Another feature and advantage of the present disclosure is that there are sometimes voltage variations in the pump motor of 8 to 18 volts, but the pressure at the outlet remains essentially constant. Increase in voltage does not affect the operation. In cold weather when the voltage is down and the starter operating, the pump may see only 4 volts but it will function successfully. When the alternator kicks in the pump may see 14 to 18 volts but the output is not significantly affected.

I claim:

1. A power driven electric fuel pump comprising:
(a) an elongate housing having a fuel inlet at one end and a fuel outlet at the other including an inlet housing having an inlet passage and an outlet housing having an outlet passage,
(b) a rotary pump adjacent said inlet housing having an inlet plate, a rotor housing, a rotor in said housing, and an outlet plate,
(c) means for rotating said rotor in said housing, and
(d) a relief valve for said pump comprising a plurality of radially spaced inner and outer annular ridges on the face of said inlet plate forming pressure chambers within and between said ridges, and a relief valve plate biased in direction toward said ridges movable against said bias to by-pass fluid pressure from said pump.

2. A fuel pump as defined in claim 1 in which said relief valve plate overlies radially both of said radially spaced annular ridges.

3. A fuel pump as defined in claim 1 in which said relief valve plate has a resilient face in contact with said ridges.

4. A fuel pump as defined in claim 1 in which said pump inlet plate has a central protuberance extending toward said inlet housing, a cup-like recess formed in said relief valve facing said inlet housing to receive said protuberance, and a compression spring seated at one end around the outer walls of recess and at the other end against a portion of said inlet housing.

5. A fuel pump as defined in claim 4 in which a flexible cup-like dampener cap having a flange at the open end is positioned around said cup-like recess and said protuberance projecting toward said inlet housing, the flange of said cap being sealed to said relief plate by said compression spring.

6. A fuel pump as defined in claim 1 in which a compression spring is located between said inlet housing and said relief valve plate, and means forming a pivotal needle bearing connection between said spring and said plate.

7. A fuel pump as defined in claim 1 in which said relief valve plate has a conical projection extending toward said inlet housing, a cup-like element having a conical recess to cooperate with said projection to form a pivotal, needlepoint connection, and a compression spring having one end bearing against said cup-like element to exert pressure on said plate.

8. A fuel pump as defined in claim 7 in which a screw adjustably positioned in said inlet housing forms a seat for the other end of said compression spring.

9. A fuel pump as defined in claim 1 in which said means for rotating said rotor comprises an armature in said housing and said outlet housing comprises a molded part in which are embedded around said armature an arcuate permanent magnet assembly encompassed by a flux ring.

10. A fuel pump as defined in claim 1 in which said outlet housing has a cylindrical recess open at one end only, and a resilient hat-shaped member in said recess having a rim secured at the base of said recess by a retaining ring in an air tight seal to form a dampener and pulse absorber in the operation of said pump.

11. A power driven electric fuel pump comprising:
(a) an elongate housing having a fuel inlet at one end and a fuel outlet at the other including an inlet housing having an inlet passage and an outlet housing having an outlet passage,
(b) a rotary pump adjacent said inlet housing having an inlet plate, a rotor housing, a rotor in said housing, and an outlet plate,
(c) means for rotating said rotor in said housing, and
(d) a relief valve for said pump comprising a plurality of radially spaced inner and outer annular ridges on the face of said inlet plate forming pressure chambers within and between said ridges, and a relief valve plate biased in direction toward said ridges movable against said bias to by-pass fluid pressure from said pump, the outer of said two ridges extending axially in a broken wall outwardly of said ridges to confine said relief valve plate peripherally while permitting the escape of fluid passing said first ridge.

12. A power driven electric fuel pump comprising:
(a) an elongate housing having a fuel inlet at one end and a fuel outlet at the other including an inlet housing having an inlet passage and an outlet housing having an outlet passage,
(b) a rotary pump adjacent said inlet housing having an inlet plate, a rotor housing, a rotor in said housing, and an outlet plate,
(c) means for rotating said rotor in said housing, and
(d) a relief valve for said pump comprising a plurality of radially spaced inner and outer annular ridges on the face of said inlet plate forming pressure chambers within and between said ridges, and a relief valve plate biased in direction toward said ridges movable against said bias to by-pass fluid pressure from said pump, the outer of said two ridges extending axially in a broken wall outwardly of said ridges to confine said relief valve plate peripherally while permitting the escape of fluid passing said first ridge, the periphery of said relief valve plate being in close contact with said outer ridge in closed position.

13. A power driven electric fuel pump comprising:
(a) an elongate housing having a fuel inlet at one end and a fuel outlet at the other including an inlet housing having an inlet passage and an outlet housing having an outlet passage, (b) a rotary pump adjacent said inlet housing having an inlet plate, a rotor housing, a rotor in said housing, and an outlet plate, (c) means for rotating said rotor in said housing, and (d) a relief valve for said pump comprising a plurality of radially spaced inner and outer annular ridges on the face of said inlet plate forming pressure chambers within and between said ridges, and a relief valve plate biased in direction toward said ridges movable against said bias to by-pass fluid pressure from said pump, the outer of said two ridges extending axially in a broken wall outwardly of said ridges to confine said relief valve plate peripherally while permitting the escape of fluid passing said first ridge, the periphery of said relief valve plate being in close contact with said outer ridge in closed position, the periphery of said relief valve plate having a radial clearance relative to said outer ridge in the range of 0.001" to 0.003".

14. A power driven electric fuel pump comprising:

(a) an elongate housing having a fuel inlet at one end and a fuel outlet at the other including an inlet housing having an inlet passage and an outlet housing having an outlet passage, (b) a rotary pump adjacent said inlet housing having an inlet plate, a rotor housing, a rotor in said housing, and an outlet plate, (c) means for rotating said rotor in said housing, (d) a relief valve for said pump comprising a plurality of radially spaced inner and outer annular ridges on the face of said inlet plate forming pressure chambers within and between said ridges, and a relief valve plate biased in direction toward said ridges movable against said bias to by-pass fluid pressure from said pump, (e) a cup-like recess formed in said relief plate valve extending toward said inlet housing, and (f) a compression spring seated at one end around the outer walls of said cup-like recess and at the other end against said inlet housing.

* * * * *